US009565506B2

(12) United States Patent
Veneri et al.

(10) Patent No.: US 9,565,506 B2
(45) Date of Patent: Feb. 7, 2017

(54) INTERFACE FOR EXPANDING THE DYNAMIC INTERVAL OF AN INPUT SIGNAL OF AN ACOUSTIC TRANSDUCER

(71) Applicant: STMICROELECTRONICS S.R.L., Agrate Brianza (IT)

(72) Inventors: Marco Veneri, Milan (IT); Alessandro Morcelli, Montello (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 171 days.

(21) Appl. No.: 14/532,960

(22) Filed: Nov. 4, 2014

(65) Prior Publication Data

US 2015/0124981 A1 May 7, 2015

(30) Foreign Application Priority Data

Nov. 5, 2013 (IT) ..... TO2013A0901

(51) Int. Cl.
*H04R 29/00* (2006.01)
*H04R 3/00* (2006.01)

(52) U.S. Cl.
CPC ..... *H04R 29/004* (2013.01); *H04R 3/00* (2013.01); *H04R 3/005* (2013.01); *H04R 29/005* (2013.01)

(58) Field of Classification Search
CPC ..... H04R 29/004; H04R 3/005; H04R 3/00; H04R 29/005
USPC ..... 381/58, 119
See application file for complete search history.

(56) References Cited

U.S. PATENT DOCUMENTS 6,271,780 B1 8/2001 Gong et al.
8,223,981 B2 * 7/2012 Haila ..... H04R 3/005 381/57
2007/0160240 A1 7/2007 Ito et al.
2009/0164212 A1 6/2009 Chan et al.
2013/0294622 A1 11/2013 Kasai et al.
2014/0010374 A1 1/2014 Kasai et al.
2014/0133677 A1 5/2014 Zerbini et al.
2014/0191343 A1 7/2014 Kasai et al.

FOREIGN PATENT DOCUMENTS

WO 2009/143434 A2 11/2009

* cited by examiner

*Primary Examiner* — Paul S Kim
(74) *Attorney, Agent, or Firm* — Seed IP Law Group LLP

(57) ABSTRACT

An interface for expanding a signal starting from a first sensing signal and a second sensing signal, wherein a receiving intensity measuring element generates an intensity signal; and a selector is controlled to select each time the first sensing signal, the second sensing signal, or a combined signal deriving from a weighted combination of these signals. The selector uses a plurality of thresholds variable as a function of the intensity signal.

23 Claims, 6 Drawing Sheets

INTERFACE FOR EXPANDING THE DYNAMIC INTERVAL OF AN INPUT SIGNAL OF AN ACOUSTIC TRANSDUCER

BACKGROUND

Technical Field

The present disclosure relates to an interface for expanding the dynamic interval of an input signal, in particular of an audio signal of an acoustic transducer having two detection structures, and to the related method.

Description of the Related Art

Acoustic transducers are known, for example MEMS (MicroElectroMechanical System) microphones, comprising a micromechanical sensitive structure, configured to transduce acoustic pressure waves into an electrical quantity (for example, a capacitive variation), and a reading electronics, configured to execute appropriate processing operations (including amplification and filtering) of the electrical quantity for supplying an electrical output signal, whether analog (for example, a voltage) or digital (for example, a PDM—Pulse Density Modulation—signal).

The electrical signal, possibly processed further by an electronic interface, is then made available for an external electronic system, for example a controller of an electronic apparatus incorporating the acoustic transducer.

The micromechanical sensitive structure in general comprises a mobile electrode, implemented as a diaphragm or membrane, facing a fixed electrode to form the plates of a variable capacitance sensing capacitor. The mobile electrode is generally anchored, through a perimetral portion, to a substrate, while a central portion thereof is free to move or bend in response to the pressure exerted by incident acoustic pressure waves and thus to modify the capacitance of the sensing capacitor. This capacitance variation affects the electrical signal generated by the sensitive structure (typically the voltage across the capacitor).

In general, the electrical performance of the acoustic transducer, and in particular its sensitivity, depends upon the mechanical characteristics of the sensitive detection structure, and moreover upon the configuration of the associated, front and rear, acoustic chambers, i.e., the chambers facing a respective, front or rear, face of the diaphragm and traversed in use by the pressure waves incident on the diaphragm and departing therefrom. These different characteristics are thus exploited in order to obtain a wide dynamic interval.

In fact, in numerous applications it is important to detect acoustic pressure waves with a wide dynamic interval, i.e., signals having a low SPL (Sound Pressure Level), a high sensitivity, and a high SNR (Signal-to-Noise Ratio) and signals having a high SPL, a lower sensitivity, and a reduced SNR.

Consequently, in the detection of acoustic pressure waves, it is important to reach an optimal compromise between wide dynamic interval, high sensitivity, and high signal-to-noise ratio.

U.S. Pat. No. 6,271,780 describes a solution for increasing the dynamic interval in an acoustic system, comprising an ADC (analog-to-digital converter), configured to receive an analog sensing signal from an acoustic transducer. This solution envisages subjecting the analog input signal, in parallel, to two signal processing paths, having a first, analog, portion and a second, digital, portion, and each having a respective amplification and gain factor for adapting to signals with low and high sound pressure level, respectively. The two digital signals at the output of the two processing paths are combined for supplying a resulting output signal. Prior to combination, the two signals have be subjected to an equalization, to take into account differences of gain, offset, and phase generated by the previous operations of processing of the signal, in part of an analog type, and thus prevent any distortion of the resulting output signal.

The above solution is not free from problems, linked principally to the complexity of the processing chain, to a non-negligible sensitivity to noise and oscillations of the input signal, to a low configurability, and to a non-optimal signal-to-noise ratio.

Another solution is described in US Patent Publication Number 2014/0133677 in the name of the present applicant.

In general, the present disclosure is directed to an improvement over the known solutions in order to extend the dynamic interval in the detection of signals, such as acoustic pressure waves, at the same time reducing the onset of artefacts during switching between channels.

BRIEF SUMMARY

Embodiments of the present disclosure are directed to a device that includes an electronic interface configured to expand a signal from a first sensing and a second sensing signal to detect a physical quantity, the signal having a first and a second dynamic interval. The electronic interface includes a first input configured to receive the first sensing signal, a second input configured to receive the second sensing signal, an output configured to supply an expanded dynamic output signal, an intensity measuring element coupled to an input between the first and second inputs and configured to generate an intensity signal, and a recombining engine that includes a reconstructed signal generator configured to receive a first level adapted signal and a second level adapted signal, correlated to the first sensing signal and to the second sensing signal, respectively, and to supply a reconstructed signal selectively correlated to the first level adapted signal, the second level adapted signal, or a combined signal derived from a weighted combination of the first and second level adapted signals, the reconstructed signal generator being configured so that the reconstructed signal switches between the first level adapted signal, the second level adapted signal, and the combined signal using a plurality of thresholds variable as a function of the intensity signal.

BRIEF DESCRIPTION OF THE SEVERAL VIEWS OF THE DRAWINGS

For a better understanding of the present disclosure, preferred embodiments thereof are now described, purely by way of non-limiting example and with reference to the attached drawings, wherein.

DETAILED DESCRIPTION

Figure 1:
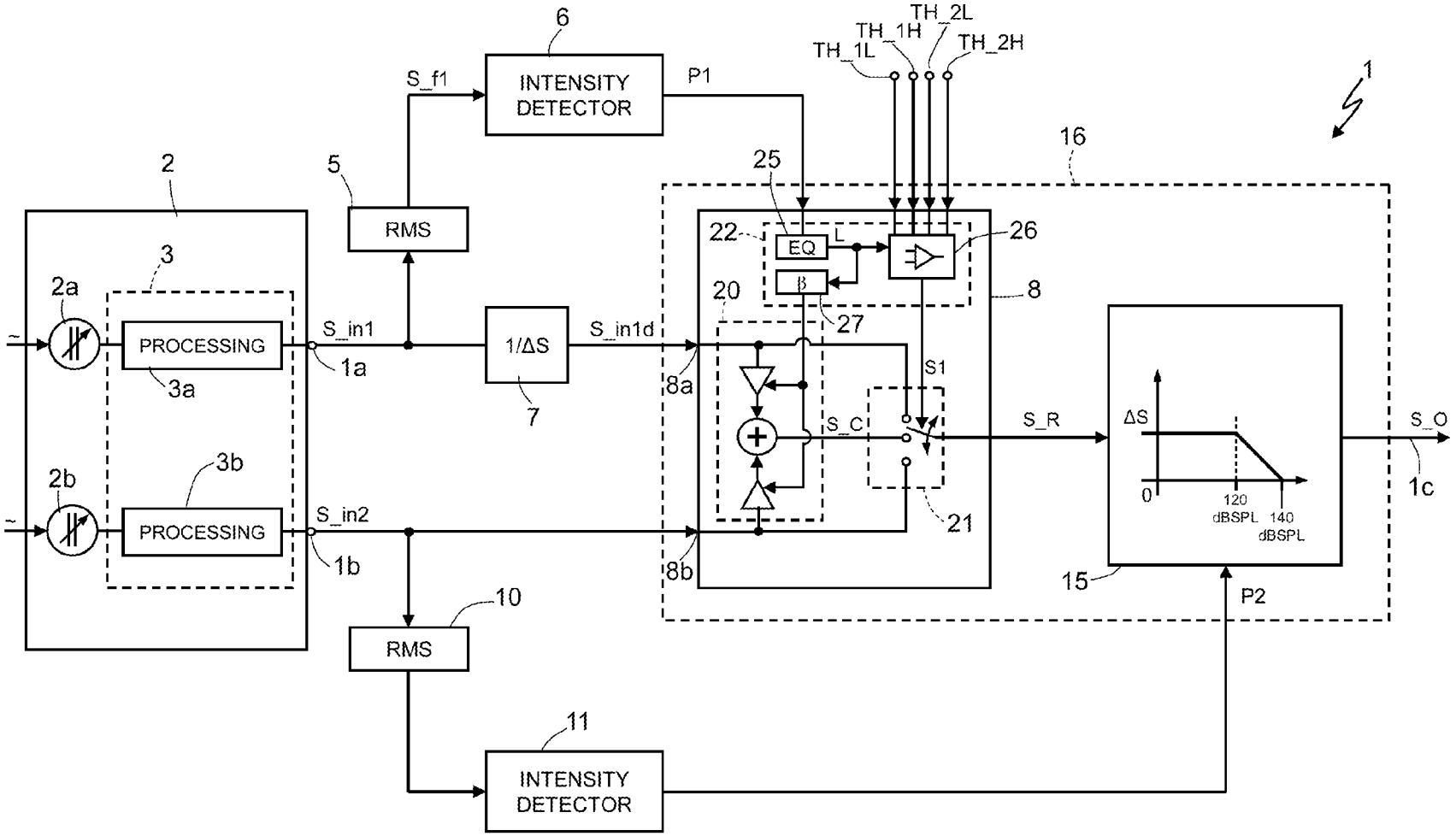
FIG. 1 is a block diagram of an embodiment of the present electronic interface, coupled to an acoustic transducer.

FIG. 1 shows a block diagram of an interface 1, here connected to the output of an acoustic transducer, designated by 2.

The interface 1 may be obtained via a hardware circuit of an analog and/or digital type or be implemented by a computer programmed with software or firmware; in the example described hereinafter, it is provided by a software-programmed computer, without, however, the following description implying any loss of generality.

Consequently, even though the following description uses the term "signal", this term also covers the digital implementation and in particular refers each time to the processed digital sample or to the sequence of processed digital samples.

The acoustic transducer 2, for example a MEMS microphone, illustrated schematically herein, comprises two distinct sensitive structures 2*a* and 2*b*. For instance, the sensitive structures 2*a* and 2*b* are micromechanical structures provided in distinct dice of semiconductor material or in distinct portions of a same die of semiconductor material, as distinct membranes or diaphragms. Alternatively, the two sensitive structures 2*a* and 2*b* may be formed by a same diaphragm having distinct areas of sensitivity, as described, for example, in WO2012093598.

The sensitive structures 2*a*, 2*b* are represented schematically in FIG. 1 a respective capacitor having a variable capacitance as a function of the incident acoustic pressure waves, and have different mechanical characteristics, for example as to different stiffness to deformations (and thus different sensitivity), which determine different electrical characteristics in the detection of the acoustic pressure waves.

The acoustic transducer 2 further comprises an ASIC 3, having a first processing element 3*a*, coupled to the first sensitive structure 2*a*, and supplying at a first output a first sensing signal S_in1 as a function of the electrical signals transduced by the first sensitive structure 2*a*; and a second processing element 3*b*, coupled to the second sensitive structure 2*b*, and supplying on a second output a second sensing signal S_in2, as a function of the electrical signals transduced by the second sensitive structure 2*b*. The sensing signals S_in1 and S_in2 are typically digital signals, but may also be analog signals. Thus, according to the type of sensing signal S_in1, S_in2, the processing elements 3*a*, 3*b* execute sampling, preamplification and/or filtering operations, in a per se known manner.

In particular, the first sensitive structure 2*a* may be more flexible and thus able to detect lower acoustic signals, having a first maximum sound pressure level, for example an AOP (Acoustic Overload Point) equal to 120 dBSPL, whereas the second sensitive structure 2*b* may be more rigid, and thus able to detect higher acoustic signals, having a second maximum sound pressure level, higher than the first maximum level, for example an AOP equal to 140 dBSPL.

Furthermore, the two sensitive structures 2*a*, 2*b* may have a same dynamic noise range DNR.

Figure 2:
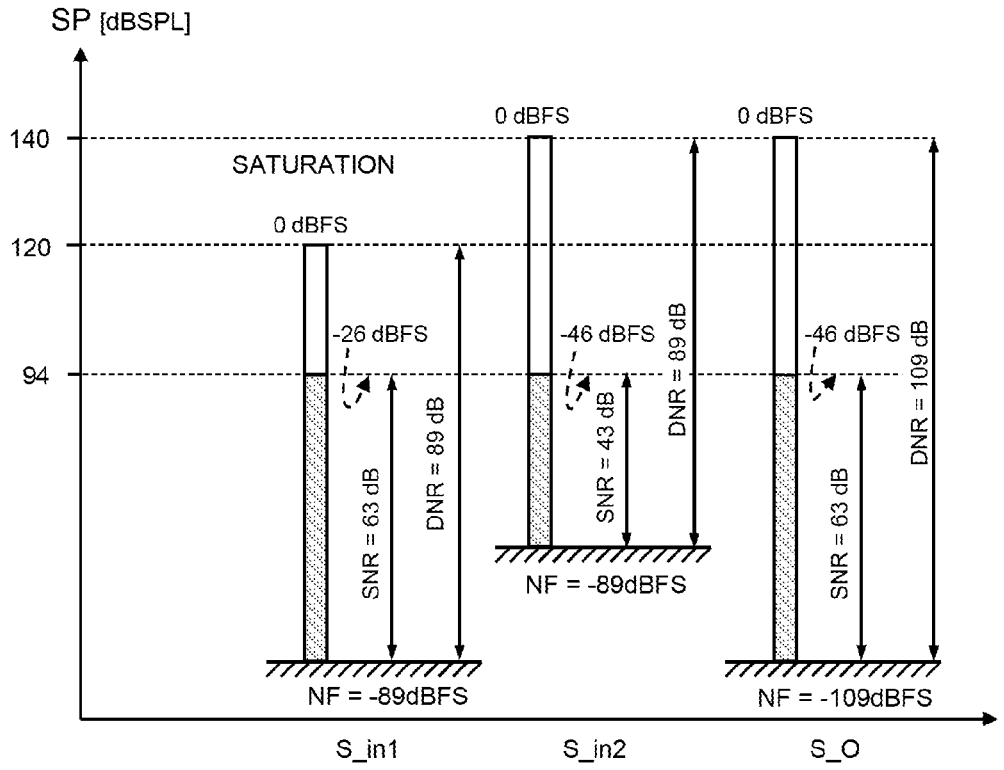
FIG. 2 shows a graph regarding acoustic quantities associated to the interface represented in FIG. 1.

FIG. 2 shows, for example, the dynamic intervals of the sensing signals S_in1 and S_in2 of an acoustic transducer 2 having the maximum sound pressure levels referred to above (different saturation values) and a same dynamic noise range DNR of 89 dB.

For a same signal (i.e., in the presence of a same SPL value) the first channel 3*a* thus generates an electrical signal having a higher value than the second channel 3*b*, as may be noted immediately in the case of a sound pressure level of 94 dBSPL (S_in1=−26 dBFs and S_in2=−46 dBFs).

Figure 4:
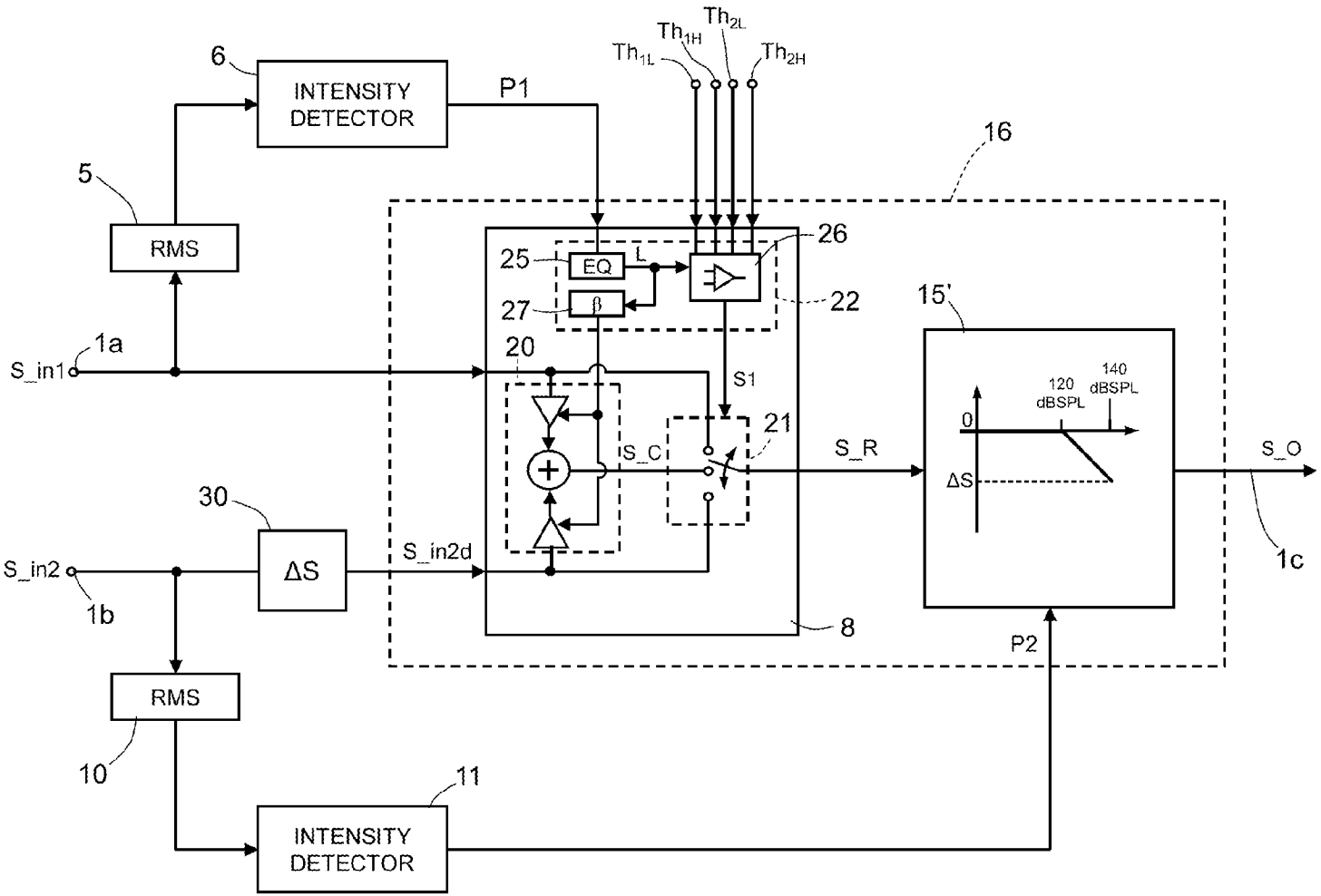
FIG. 4 is a block diagram of a different embodiment of the present electronic interface.

Consequently, as explained hereinafter, the interface carries out a level adaptation. For instance, in the embodiment represented in FIG. 1, the first sensing signal S_in1 is reduced by a value equal to the level difference at the value of sound pressure level of 94 dBSPL, thus generating a first level adapted signal S_in1*d*. Alternatively (as illustrated in FIG. 4), it is possible to increase the second sensing signal S_in2 by the same difference, thus generating a second level adapted signal S_in2*d*.

As described in detail hereinafter, the electronic interface 1 carries out a combination of the first and second sensing signals S_in1, S_in2, for generating a combined signal, in order to widen the dynamic interval and obtain an optimized compromise with the signal-to-noise ratio, preventing undesirable clicks, pops, and fading.

Figure 3:
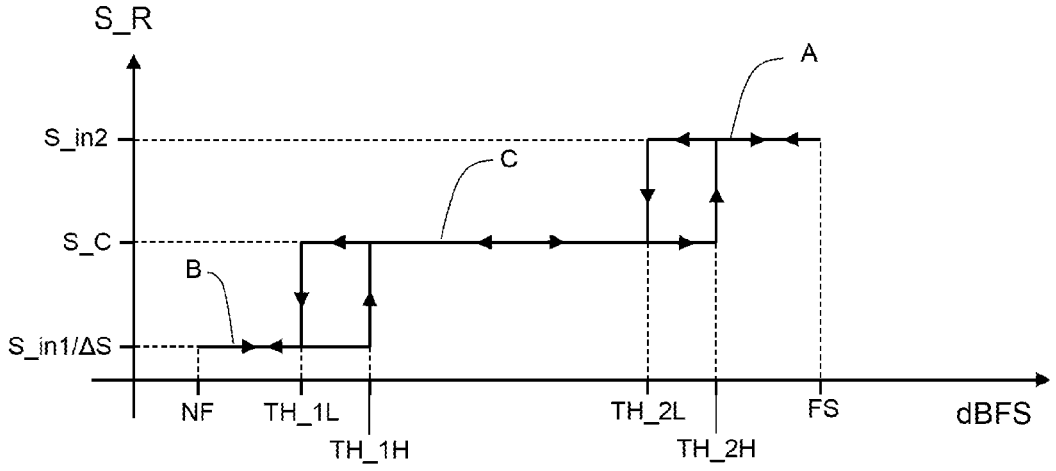
FIG. 3 is a graph representing conceptually the generation of the output signal of the interface of FIG. 1.

In detail, the combination here uses the value of an intensity (loudness) signal L that is correlated to a sensing signal, preferably to the first sensing signal S_in1, and is compared with a plurality of thresholds, variable as a function of the intensity signal L. In FIG. 1 there are four different thresholds, forming two lower thresholds and two upper thresholds, referred to hereinafter also as a first lower threshold TH_1L, a second lower threshold TH_1H, a first upper threshold TH_2L, and a second upper threshold TH_2H, with TH_1L<TH_1H<TH_2L<TH_2H. These thresholds are illustrated in FIG. 3 and are used for calculating a reconstructed signal S_R as follows:

when, starting from an intermediate value comprised between TH_1L and TH_2L, the intensity signal L increases until it exceeds the second upper threshold TH_2H, the second sensing signal S_in2 is selected (stretch A of the curve of FIG. 3);

when, starting from an intermediate value comprised between TH_2H and TH_1H, the intensity signal L decreases until it drops below the first lower threshold TH_1L, the first sensing signal S_in1 is selected (but for an attenuation or reduction of gain, as explained in detail hereinafter), (stretch B of the curve of FIG. 3);

when the intensity signal L has a value comprised between the first lower threshold TH_1L and the second upper threshold TH_2H, without exceeding these thresholds, a signal is selected, indicated in FIG. 3 as combined signal S_C resulting from a combination of the first and second sensing signals S_in1, S_in2 (stretch C of the curve of FIG. 3).

In practice, the system works on the basis of a hysteresis that tends to reduce the number of switchings, maintaining the sensing signal or the combination that had been selected previously even beyond the value of the (lower or upper) threshold that determines switching in the opposite direction. In this way, but for a final level adaptation, as explained hereinafter, the interface 1 generates a reconstructed signal S_R as illustrated in FIG. 2 having an increased dynamic, which ranges from the minimum sound pressure level (SPL) detectable by the first detection structure 2*a*, which is more sensitive to the low sound waves, to the maximum sound pressure level (SPL) detectable by the second detection structure 2*b*, which is more sensitive to high sound waves.

Furthermore, in the present interface, the combination of the first and second sensing signals S_in1, S_in2 is made using a non-linear factor or weight of a self-adaptive type that enables slow and smooth switching between the first and second sensing signals S_in1, S_in2 and the combined signal.

Then, in the present interface, the combined signal S_C thus obtained is amplified or attenuated using a variable gain for recovering the original amplitude of the low/high signal, thus preventing saturation. To this end, in the implementation represented in FIG. 1, an expander amplifies the combined signal if this is lower than an amplification threshold and, after this amplification threshold, reduces the amplification gain linearly, down to zero at the full scale value.

With reference once again to FIG. 1, the interface 1 has a first and a second input 1*a* 1*b*, configured to receive the first and second sensing signals S_in1, S_in2, respectively, directly from the acoustic transducer 2, and an output 1*c*, supplying an output signal S_O.

The electronic interface 1 comprises a first filtering element 5 connected to the first input 1*a*; a first intensity detector 6, connected to the output of the first filtering element 5; a first level adapter 7, connected to the first input 1*a*; a signal reconstructor 8, connected to the outputs of the first intensity detector 6 and of the first level adapter 7 and to the second input 1*b* of the interface; a second filtering element 10 connected to the second input 1*b* of the interface; a second intensity detector 11, connected to the output of the second filtering element 10; and a second level adapter 15, connected to the output of the signal reconstructor 8 and to the output of the second peak detector 11. The signal reconstructor 8 and the second level adapter 15 form together a recombining engine 16.

The first level adapter 7 has the function of reducing the level of the first sensing signal S_in1 by a reduction or attenuation value ΔS for generating a first adapted sensing signal S_in1*d* having, for a sound signal picked up with a sound pressure level of 94 dBSPL, an amplitude equal to that of the second sensing signal S_in2 (in the example represented in FIG. 2, thus, ΔS=20 dB). The signal reconstructor 8 then receives, on two signal inputs 8*a*, 8*b* of its own, the adapted sensing signal S_in1*d* and the second sensing signal S_in2.

The first filtering element 5 has the purpose of reducing the variation rate of the first sensing signal S_in1 and thus simplifying processing; it may be formed by any element suited for this purpose. For instance, in a software implementation of the electronic interface 1, the first filtering element 5 may be formed by an element computing the RMS (Root Mean Square) value. A first filtered signal S_f1 is thus present at output of the first filtering element 5 and supplied to the first intensity detector 6. The first intensity detector 6 is substantially a peak detector, which thus outputs a first peak signal P1, used by the signal reconstructor 8 as described hereinafter.

Figure 9:
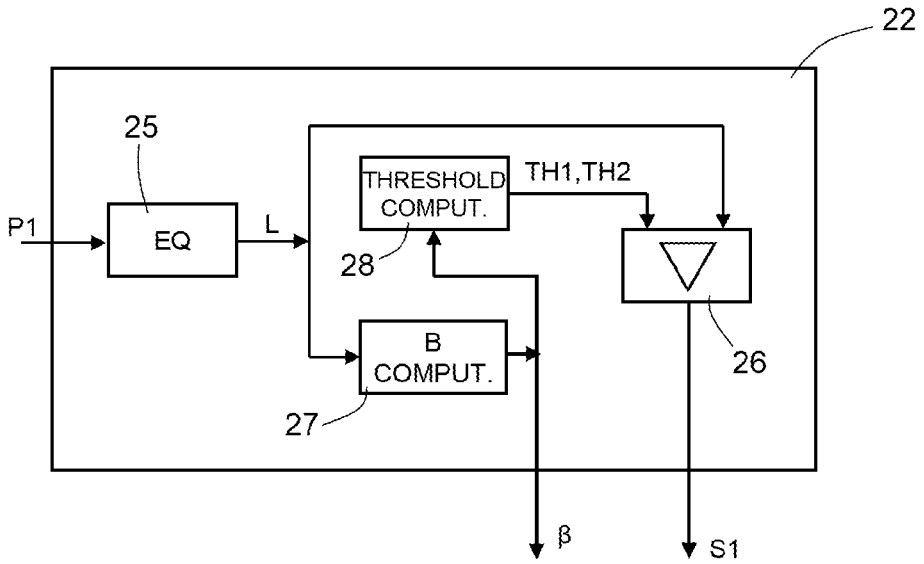
FIG. 9 shows a variant of a block of FIG. 1.

In the embodiment of FIG. 9, the signal reconstructor 8 does not actually generate the four thresholds TH_1L, TH_1H, TH_2L and TH_2H described above, but calculates two dynamic thresholds, a lower dynamic threshold TH1 and an upper dynamic threshold TH2, the value whereof is dynamically and repeatedly calculated for reproducing the above hysteresis behavior described with reference to FIG. 3, as disclosed in detail hereinafter.

In the embodiment of FIG. 1, the signal reconstructor 8 is basically made up of three parts: an adder 20, which receives the adapted sensing signal S_in1*d* and the second sensing signal S_in2 and generates a weighted combination thereof, referred to previously (and in FIG. 3) as combined signal S_C; a selector 21, which makes the selection referred to above and then outputs the reconstructed signal S_R according to the criteria set forth above; and a control portion 22, which controls the selector 21 and generates a combination factor β for the adder 20. For instance, the adder 20 may generate the combined signal S_C as:

$$S_C = S_in1d \cdot (1-\beta) + S_in2 * \beta$$

The control portion 22 comprises an equalizer 25, a threshold computing unit 28 (see FIG. 9), a comparator 26, and a weight generator 27.

Figure 5:
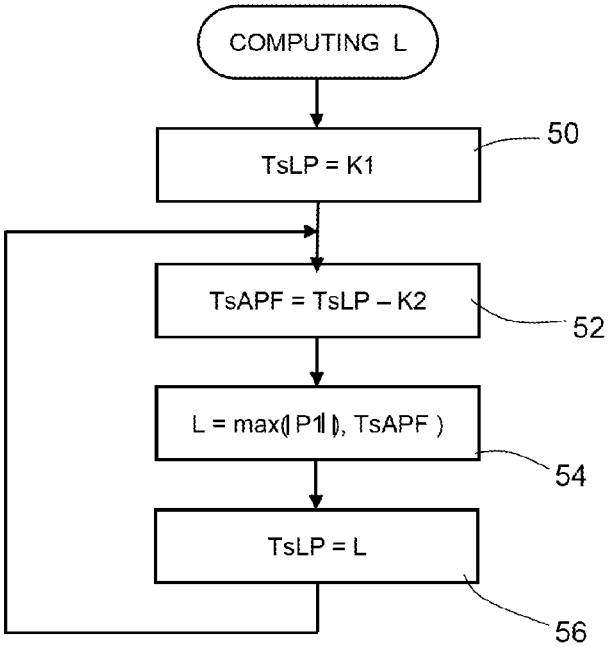
FIGS. 5-8 are flowcharts regarding operations carried out by the present electronic interface.

In detail, the equalizer 25 is formed by a filter having the task of further reducing the variation rate of the signal to be compared with the switching thresholds (intensity signal L). In particular, the equalizer 25 reacts rapidly while the sound signal increases, but more slowly when the picked up sound signal drops, and thus introduces a delay in this phase. For instance, the equalizer 25 may execute the operations illustrated in FIG. 5, namely:

- it resets a previous peak value TsLP to a value K1 (step 50);
- it calculates a peak decay value TsAPF reducing the previous peak value TsLP by a decay value K2 (step 52);
- it calculates the new sample of the intensity signal L as maximum between the absolute value of the sample of the first peak signal P1 and the previous peak value TsLP (step 54); and
- it updates the new previous peak value TsLP so that this is equal to the new sample of the intensity signal L (step 56).

Figure 6A:
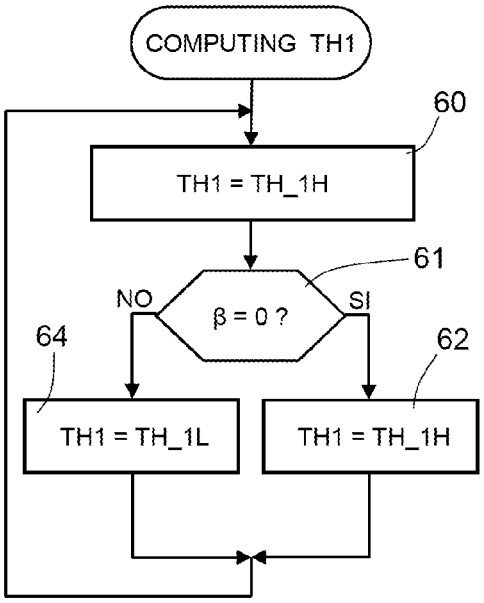
Figure 6B:
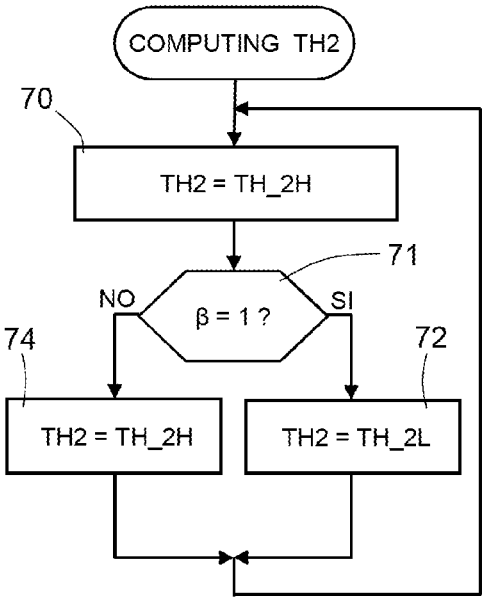

This cycle is repeated for each sample of the first peak signal P1, and then the process returns to step 52. In FIG. 9, the control portion 22 comprises, in addition to the equalizer 25, to the comparator 26, and to the weight generator 27, a threshold computing unit 28. The threshold computing unit 28 calculates the dynamic thresholds described above, executing the operations illustrated in FIGS. 6A and 6B.

In detail, for calculating the lower dynamic threshold TH1 (FIG. 6A), the threshold computing element 28:

initially sets the lower dynamic threshold TH1 to the first upper threshold TH_1H (step 60);

if the current combination factor β is equal to 0 (output YES from verification step 61 of the value of β, which means that now the reconstructed signal S_R is in stretch B of the curve of FIG. 3), sets the lower dynamic threshold TH1 to the second lower threshold TH_1H (step 62);

if the combination factor β is other than 0 (output NO from step 61; i.e., now the reconstructed signal S_R is in stretch C of the curve of FIG. 3), sets the lower dynamic threshold TH1 to the first lower threshold TH_1L (step 64).

For calculation of the upper dynamic threshold TH2 (FIG. 6B), the threshold computing unit 28:

initially sets the upper dynamic threshold TH2 to the second upper threshold TH_2H (step 70);

if the combination factor β is equal to 1 (output YES from the verification step 71; i.e., the reconstructed signal S_R is in stretch A of the curve of FIG. 3), sets the upper dynamic threshold TH2 to the second lower threshold TH_2L (step 72);

if the combination factor β is other than 1 (output NO from step 71; i.e., the reconstructed signal S_R is in stretch C of the curve of FIG. 3), sets the upper dynamic threshold TH1 to the second upper threshold TH_2H (step 74).

According to an embodiment of the present device, the combination factor β generated by the weight generator 27 is not fixed, but is a variable self-adaptive value so that the combined signal S_C follows the dynamic of the input signal without discontinuity and has a value close to that of the adapted sensing signal S_in1*d* when the intensity signal L has exceeded the first upper threshold TH_1L and a value close to that of the second sensing signal S_in2, when the intensity signal L has dropped below the second lower threshold TH_2L.

Figure 7:
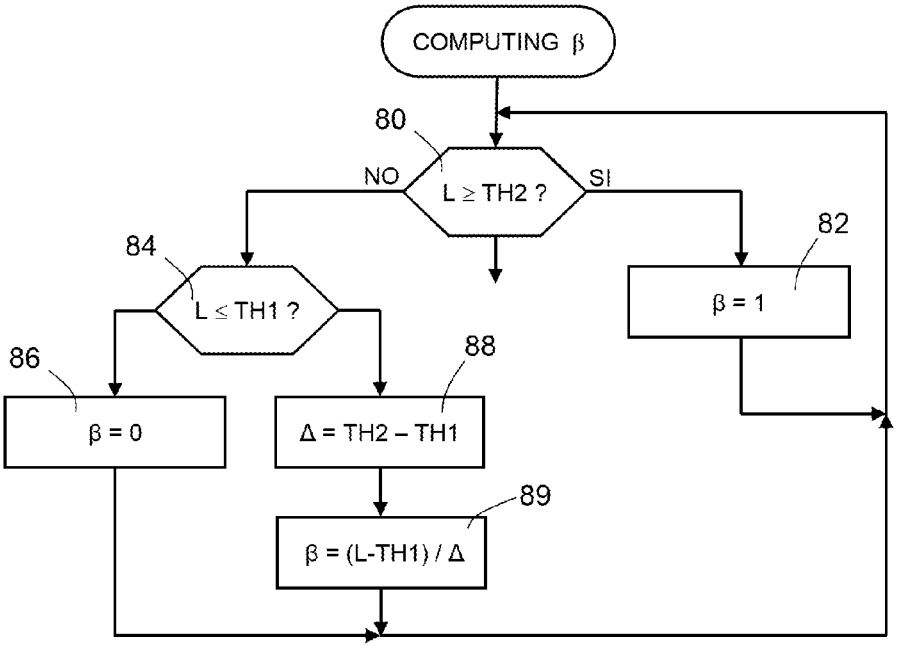

For instance, the combination factor β is recalculated for each sample as follows (see FIG. 7):

initially, the intensity signal L is compared with the upper dynamic threshold TH2 (step 80);

if L≥TH2, the combination factor β is set to 1 (step 82);

otherwise, the weight generator 28 verifies whether the intensity signal L is lower than or equal to the lower dynamic threshold TH1 (step 84);

if it is, the combination factor β is set to 0 (step 86);

if it is not, the distance between the upper dynamic threshold TH2 and the lower dynamic threshold TH1 is calculated (step 88) and the combination factor β is set to the normalized distance between the value of the intensity signal L and the lower dynamic threshold TH1 (step 89).

The comparator 26 receives the upper dynamic threshold TH2, the lower dynamic threshold TH1 and the value of the intensity signal L and generates a digital switching signal S1 supplied to a control input of the selector 21, which thus outputs the reconstructed signal S_R. The reconstructed signal S_R thus generated is supplied to the second level adapter 15, which amplifies it for recovering the original intensity, reduced on account of the first level adapter 7, but only for the portion due to the first sensing signal S_in1.

To this end, the intensity of the input signal is measured using the second sensing signal S_in2, since the latter contains the information regarding the high part of the sound signal picked up by the transducer 2, which is not to be amplified.

In detail, the second input 1*b* of the electronic interface 1 is connected to the second filtering element 10, which may be made substantially in the same way as the first filtering element 5 and may be formed by an RMS calculation element. The second filtering element 10 thus outputs a second filtered signal S_f2, supplied to the second intensity detector 11. The second intensity detector 11, forming substantially a peak detector, outputs a second peak signal P2, supplied to the second level adapter 15 to determine the level of gain intended for the reconstructed signal S_R.

The second level adapter 15 operates substantially as an amplifier of the reconstructed signal S_R, which has a constant gain ΔS (thus equal to the reduction of the first level adapter 7, in the example equal to 20 dB) up to a certain level of the input signal (here up to 120 dBSPL, maximum level of the first sensing signal S_in1) and then decreases.

In an embodiment of the present device, in the above second interval, the amplitude of the reconstructed signal S_R is reduced linearly down to zero at the maximum detectable level (in the example considered 140 dBSPL).

According to a different embodiment, in this second interval, a maximum gain of the reconstructed signal S_R is reduced linearly to zero at the maximum detectable level (in the example considered, 140 dBSPL). In practice, in this case, when the second sensing signal S_in2 exceeds 120 dBSPL, the second level adapter 15 calculates the maximum gain on the basis of the following law:

$$G\max=\min(\Delta S,\ 140\ \text{dBSPL}-P2)$$

Gmax represents the maximum gain that may be applied to the output signal without the latter undergoing any saturation or—in other words—without the latter being amplified beyond what is allowed by the residual dynamic of the system (headroom).

According to an embodiment of the present device, in order not to introduce sharp alterations in the dynamic of the output signal S_O, the gain G actually applied to the reconstructed signal S_R is calculated in an adaptive way that depends upon the maximum gain Gmax. In particular, the gain G follows two different dynamics according to whether it is increasing or decreasing (and thus the second sensing signal S_in2 and the reconstructed signal S_R are decreasing or increasing).

Specifically, here, the gain is increased slowly according to a preset constant, and is decreased in a faster way according to a value linked to the amount of reduction of the maximum gain, implementing a sort of exponential decay. For instance, in the second range of values, the gain G is calculated as illustrated in FIG. 8.

Figure 8:
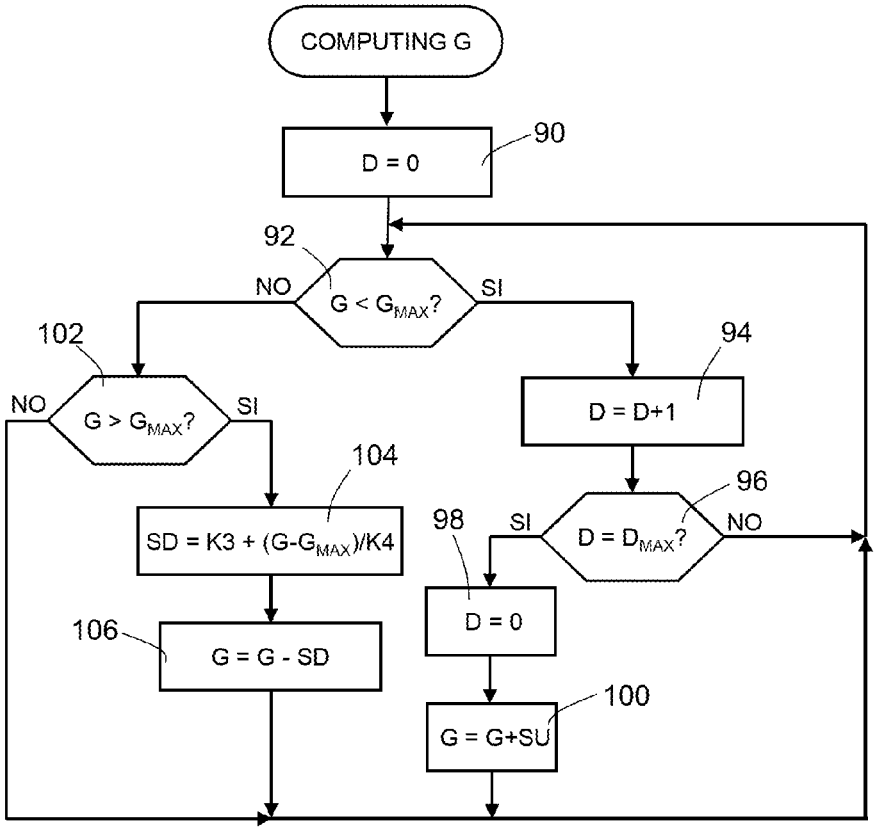

In the example of FIG. 8, the second level adapter 15 carries out the following operations:

it initializes a delay counter D to zero (step 90);

it verifies whether the value of the gain G is lower than the maximum gain GMAX corresponding to the current value of the second sensing signal S_in2 (or of an average of a certain number of samples) (step 92);

if G<GMAX, it increments the delay counter D (step 94);

it verifies whether the delay counter D has already reached the intended maximum value (step 96);

if it has not, it returns to step 92;

if it has, it resets the delay counter D (step 98), and increments the gain G by a step-up value SU (step 100), and returns to step 92;

if G is at least equal to GMAX (calculated at the current value or at a value that is an average of a certain number of samples of the second sensing signal S_in2), output NO from step 92, it verifies whether G>GMAX (step 102);

if it is not (i.e., G=GMAX), it returns to step 92, without modifying the value of the gain;

if it is (i.e., the second sensing signal S_in2 is decreasing), it calculates a step-down value SD linked to the increase rate of the second sensing signal S_in2 (and thus the decrease rate of the maximum gain GMAX) according to the equation SG=K3+(G−GMAX)/K4, where K3 and K4 are constant (step 104);

it increments the gain G by the step-down value SD (step 106), and returns to step 92.

The interface described herein has numerous advantages.

The use, during reconstruction of the signal, of a number of thresholds that take into account the dynamic of the picked up sound signal, with a hysteresis behavior, reduces the number of switchings between the used signals and thus the onset of artefacts and disturbance, such as, in the acoustic field, clicks, pops, or fading.

The reduction of artefacts and disturbance, for an increase of the dynamic interval of reproduction of the picked up signal, is enhanced by the other measures implemented by the present interface. In particular, the process of repeated filtering of the low signal (first sensing signal S_in1) to obtain the intensity signal L that is used for comparison with the reconstruction thresholds of the signal is advantageous since also this solution contributes to reducing repeated switchings at a short distance, as likewise the non-linear dependence of the gain G effectively applied to the reconstructed signal S_R in the high value area.

The above improved behavior is also due to the use of self-adaptive weights in the generation of the combined signal S_C, which cause the reconstructed signal S_R to move without discontinuity and smoothly from the previous values to the subsequent ones in all operating conditions. In this way, thanks to the ensemble of solutions described above, even when the picked up signal has sudden level variations, difficult to predict, it is possible to completely eliminate the artefacts, at the same time guaranteeing a wide dynamic interval and high definition.

The final level adapter or expander 15 moreover ensures complete recovery of the amplitude of the picked up signal, at the same time preventing saturation of the output. The output signal thus obtained, where just the lower values are amplified and amplification of the higher values is gradually reduced, limits the presence of noise in the output signal in so far as this is not amplified in a troublesome way for the samples having a higher level.

Finally, it is clear that modifications and variations may be made to the interface and to the reconstruction method described and illustrated herein, without thereby departing from the scope of the present disclosure, as defined in the attached claims.

For instance, the interface may work in a dual way for alignment of the signals at the input of the signal reconstructor 8. A solution of this type is illustrated by way of example in FIG. 4, which shows an interface altogether similar to that of FIG. 1, except for the fact that the signal reconstructor 8 receives at input the first sensing signal S_in1 and a second adapted sensing signal S_in2*d* obtained by amplifying by ΔS the second sensing signal S_in2 (via a third level adapter, here an amplifier 30, arranged between the second input 1*b* and the signal reconstructor 8). Furthermore, in this embodiment, the output from the signal reconstructor 8 is connected to a fourth level adapter 15', which operates opposite to the second level adapter 15 of FIG. 1; i.e., it maintains the level of the combined signal S_R up to a certain value (for example, the maximum level of the first sensing signal S_in1) and then reduces the gain (or the maximum gain) linearly down to −ΔS at the maximum level of the second sensing signal S_in2.

The measurement branch of the intensity signal L may be coupled to the second input 1*b* and the measurement branch of the control signal of the second adapter element 15, 15' may be coupled to the first input 1*a*, even though the embodiments described above have the advantage of optimally exploiting the information associated to the first and second sensing signals S_in1, S_in2.

Figure 10:
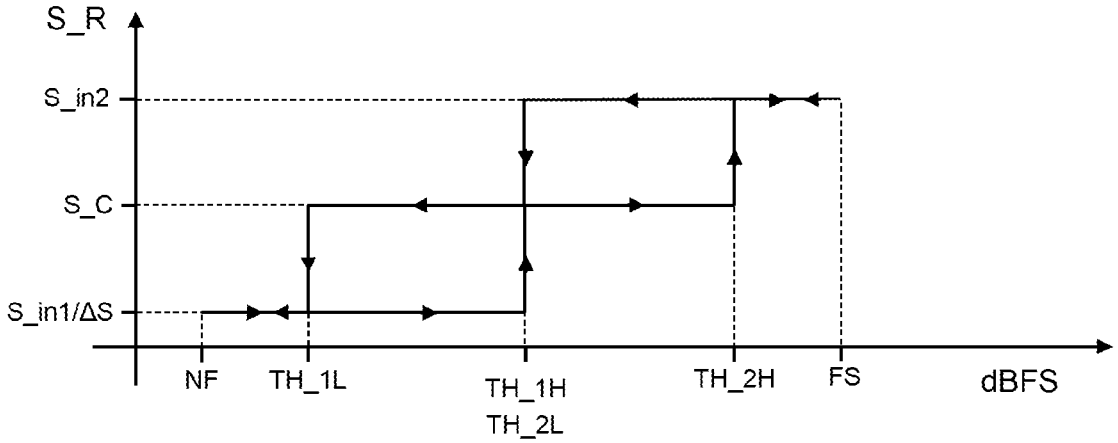
FIG. 10 is a variant of the graph if FIG. 3.

In the examples described above, the control portion 22 works on two dynamic thresholds, the value whereof is automatically calculated for each signal sample or every n signal samples for having in practice four thresholds. According to yet another embodiment, illustrated in FIG. 10, the control portion may use three thresholds, thereby the thresholds TH_1H and TH_2L of FIG. 1 become the same. In all cases, the thresholds are programmable in an initial setting step.

Furthermore, even though the threshold computing unit 28 and the weight generators 27 have been described as different entities, they may be implemented by a same logic unit, possibly as separate routines. Likewise, the adder 20 and the selector 21 may be implemented by a single reconstructed signal generator S_R.

The present interface may be used for processing audio signals both of a digital type and of an analog type.

Furthermore, as has been mentioned, the described solution may be usefully applied to signals detected by dual sensors, including non-acoustic ones. The method proposed for managing two signals with different sensitivity in order to create one with greater dynamic interval may in fact be used for different applications, such as for example MEMS inertial sensors, thermal sensors, or pressure sensors, environmental sensors, chemical sensors, etc. In these cases, the availability of elements with different sensitivity may exploit the advantage of the described interface and method, for supplying more precise information and over a more extensive range of values, without introducing artefacts or alterations in the treated signal.

The various embodiments described above can be combined to provide further embodiments. Aspects of the embodiments can be modified, if necessary to employ concepts of the various patents, applications and publications to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electronic interface, comprising:

a first input configured to receive a first sensing signal;

a second input configured to receive a second sensing signal;

an output configured to supply an expanded dynamic output signal;

an intensity measuring element coupled to the first input or the second input and configured to generate an intensity signal; and a recombining engine that includes a reconstructed signal generator configured to receive a first signal and a second signal, correlated to the first sensing signal and to the second sensing signal, respectively, and to supply a reconstructed signal selectively correlated to the first signal, the second signal, and a combined signal derived from a weighted combination of the first and second signals, the reconstructed signal generator being configured to output the reconstructed signal based on a plurality of thresholds that are variable as a function of the intensity signal, the reconstructed signal being one of the first signal, the second signal, and the combined signal.

2. The interface according to claim 1 wherein the reconstructed signal generator is configured to generate the reconstructed signal according to a first hysteresis curve in a first mode, in which the reconstructed signal generator outputs one of the first signal and the combined signal and the reconstructed signal generator is configured to generate the reconstructed signal according to a second hysteresis curve in a second mode in which the reconstructed signal generator outputs one of the second signal and the combined signal.

3. The interface according to claim 1 wherein the reconstructed signal generator includes an adder configured to generate the combined signal, and a selector element configured to:

receive the first signal, the second signal, and the combined signal, switch from outputting the combined signal to outputting the first signal when the intensity signal reaches a first threshold value, switch from outputting the combined signal to outputting the second signal when the intensity signal reaches a second threshold value, different from the first threshold value, and switch from outputting one of the first and second signals to outputting the combined signal when the intensity signal reaches a third threshold value different from the first and second threshold values.

4. The interface according to claim 3 wherein the first threshold value is lower than the second threshold value, and the selector element is configured to:

switch from outputting the first signal to outputting the combined signal when the intensity signal reaches the third threshold value, which is higher than the first threshold value, and switch from outputting the second signal to outputting the combined signal when the intensity signal reaches a fourth threshold value lower than the second threshold value.

5. The interface according to claim 4 wherein the third threshold value is lower than the fourth threshold value.

6. The interface according to claim 1 wherein the intensity measuring element includes:

a filtering element coupled to the first input of the interface;

a peak detector element, coupled to the filtering element; and an equalizing element coupled to the peak detector element.

7. The interface according to claim 6 wherein the filtering element is an RMS value computing element.

8. The interface according to claim 6 wherein the equalizing element is configured so that the intensity signal has a same increase rate as a peak signal while the peak signal is increasing and a limited decrease rate during reduction of the peak signal.

9. The interface according to claim 1, further comprising an amplitude modifying element arranged between the first input and the recombining engine, the amplitude modifying element being configured to produce the first signal from the first sensing signal based on a first gain value, the recombining engine including:

a selector element configured to output the reconstructed signal; and a variable gain element arranged between the selector element and the output of the interface and having a second gain value of an opposite sign to the first gain value and variable as a function of an amplitude of the first sensing signal.

10. The interface according to claim 9 wherein the variable gain element is configured so that the second gain value has a first stretch when the first sensing signal is lower than a reference value and a second stretch when the first sensing signal is greater than a reference value, the first stretch having a constant gain, opposite to the first gain, and the second stretch having a decreasing gain.

11. The interface according to claim 10 wherein the variable gain element is configured to determine a maximum linearly decreasing gain, determine an effective gain value, and generate an effective gain value that increases according to a first constant and decreases according to a second constant, greater than the first constant.

12. The interface according to claim 1 wherein the recombining engine comprises a weight generator configured to generate variable weights as a function of the intensity signal and a weighted sum element coupled to the weight generator and configured to generate the combined signal variable between the first and second level adapted signals slowly and smoothly.

13. A method, comprising:

producing an intensity signal that is based on one of a first sensing signal and a second sensing signal;

generating a combined signal from a weighted combination of a first signal, correlated to the first sensing signal, and a second signal, correlated to the second sensing signal; and generating a reconstructed signal by selecting alternatively the first signal, the second signal, and the third signal, wherein the selecting includes comparing the intensity signal with a plurality of thresholds variable as a function the intensity signal, wherein generating the reconstructed signal includes switching between the first signal and the combined signal according to a first hysteresis curve and switching between the second signal and the combined signal according to a second hysteresis curve.

14. The method according to claim 13 wherein producing the intensity signal includes:

producing a peak signal based on detecting peaks of the first sensing signal; and filtering the peak signal so that the intensity signal has a same increase rate as the peak signal while the peak signal increases and a limited decrease rate during a reduction of the peak signal.

15. A method comprising:

producing an intensity signal that is based on one of a first sensing signal and a second sensing signal;

generating a combined signal from a weighted combination of a first signal, correlated to the first sensing signal, and a second signal, correlated to the second sensing signal; and generating a reconstructed signal by selecting alternatively the first signal, the second signal, and the third signal, wherein the selecting includes comparing the intensity signal with a plurality of thresholds variable as a function the intensity signal, wherein generating the reconstructed signal includes:

switching from outputting the first level adapted signal to outputting the combined signal when the intensity signal reaches a first threshold value, switching from outputting the second level adapted signal to outputting the combined signal when the intensity signal reaches a second threshold value different from the first threshold value, and switching from outputting the combined signal to outputting the first signal when the intensity signal reaches a third threshold value different from the first and second threshold values.

16. The method according to claim 15 wherein the first threshold value is lower than the second threshold value, and wherein generating the reconstructed signal includes switching from outputting the combined signal to outputting the second signal when the intensity signal reaches a fourth threshold value higher than the second threshold value.

17. A method, comprising:

producing an intensity signal that is based on one of a first sensing signal and a second sensing signal;

generating a combined signal from a weighted combination of a first signal, correlated to the first sensing signal, and a second signal, correlated to the second sensing signal;

generating a reconstructed signal by selecting alternatively the first signal, the second signal, and the third signal, wherein the selecting includes comparing the intensity signal with a plurality of thresholds variable as a function the intensity signal;

generating the first signal by modifying an amplitude of the first sensing signal using a first gain value;

modifying an amplitude of the reconstructed signal using a second gain value having an opposite sign to the first gain value and variable as a function of the amplitude of the second sensing signal, wherein the first gain value is constant and the second gain value is constant and opposite to the first gain value when the second sensing signal is lower than a reference value, and is a gain decreasing as a function of the second sensing signal when the second sensing signal is greater than a reference value.

18. The method according to claim 17, wherein producing the intensity signal includes:

producing a peak signal based on detecting peaks of the first sensing signal; and filtering the peak signal so that the intensity signal has a same increase rate as the peak signal while the peak signal increases and a limited decrease rate during a reduction of the peak signal.

19. A device, comprising:

a first input configured to receive a first sensed signal;

a second input configured to receive a second sensed signal; and a recombining circuit coupled to the first input and the second input, the recombining circuit including:

a combiner configured to combine the first sensed signal and the second sensed signal and to output a combined signal;

a selector coupled to the combiner and configured to receive the combined signal; and a controller coupled to the combiner and coupled to the selector, the controller configured to selectively output a reconstructed signal;

a first level adapter coupled between the first input and the recombining circuit; and a second level adapter coupled between the selector and an output of the recombining circuit.

20. The device of claim 19 wherein the controller is configured to provide a combination factor to the combiner.

21. The device of claim 19 further comprising an acoustic transducer having first and second detection structures, which have different sensitivity characteristics and are configured to generate the first and second sensed signals, respectively.

22. A method, comprising:

producing an intensity signal that is based on one of a first sensing signal and a second sensing signal;

generating a combined signal from a weighted combination of a first signal, correlated to the first sensing signal, and a second signal, correlated to the second sensing signal; and generating a reconstructed signal by selecting alternatively the first signal, the second signal, and the third signal, wherein the selecting includes comparing the intensity signal with a plurality of thresholds variable as a function the intensity signal, wherein producing the intensity signal includes:

producing a peak signal based on detecting peaks of the first sensing signal; and filtering the peak signal so that the intensity signal has a same increase rate as the peak signal while the peak signal increases and a limited decrease rate during a reduction of the peak signal.

23. The method according to claim 22, wherein generating the reconstructed signal includes:

switching from outputting the first level adapted signal to outputting the combined signal when the intensity signal reaches a first threshold value, switching from outputting the second level adapted signal to outputting the combined signal when the intensity signal reaches a second threshold value different from the first threshold value, and switching from outputting the combined signal to outputting the first signal when the intensity signal reaches a third threshold value different from the first and second threshold values.

* * * * *